United States Patent [19]

Chap

[11] Patent Number: 4,585,199

[45] Date of Patent: Apr. 29, 1986

[54] FIXTURE MOUNTING ARRANGEMENT

[75] Inventor: John P. Chap, Lemont, Ill.

[73] Assignee: Selfix, Inc., Chicago, Ill.

[21] Appl. No.: 611,592

[22] Filed: May 22, 1984

[51] Int. Cl.[4] ..... A47B 96/06

[52] U.S. Cl. ..... 248/359; 248/220.2

[58] Field of Search ..... 248/359 R, 359 D, 359 E, 248/220.2, 222.1, 223.3, 223.4, 224.1, 224.2, 224.3, 224.4, 225.1, 225.31, 231.9, 297.2; 312/245, 246; 108/152

[56] References Cited

U.S. PATENT DOCUMENTS

| | | | |
|---|---|---|---|
| 1,572,295 | 2/1926 | Kofsky | 248/220.2 |
| 1,661,188 | 3/1928 | Matthews | 248/221.3 |
| 3,529,799 | 9/1970 | Schaefer . | |
| 3,622,116 | 11/1971 | Fellowes . | |
| 3,669,035 | 6/1972 | Grossman . | |
| 3,848,843 | 11/1974 | Levy . | |
| 3,928,894 | 12/1975 | Bury et al. | 248/223.4 |
| 4,203,373 | 5/1980 | Conti | 248/297.2 |
| 4,458,872 | 7/1984 | Couch | 248/222.1 |

*Primary Examiner*—Ramon S. Britts
*Assistant Examiner*—Ramon O. Ramirez
*Attorney, Agent, or Firm*—Dressler, Goldsmith, Shore, Sutker & Milnamow, Ltd.

[57] ABSTRACT

A fixture mounting arrangement is disclosed for effecting very convenient yet secure mounting of fixtures such as soap dishes, tissue holders, towel racks, and the like. The arrangement includes a one-piece mounting plate which is adapted to be secured to a wall or like supporting surface. The mounting plate includes one or more mounting portions, and further includes a pair of mounting flanges which extend laterally from a position spaced from the supporting surface generally angularly toward the supporting surface. The mounting arrangement further includes a retaining portion which is defined by the fixture for cooperation with the mounting plate. The retaining portion of the fixture defines one or more openings for respectively receiving the one or more mounting portions of the mounting plate, and is configured such that it is positionable between the angularly extending flanges of the plate and the supporting surface. By this construction, the mounting plate may be very easily and conveniently affixed to the supporting surface, with the fixture thereafter readily mounted on the plate merely by relatively vertically moving the fixture with respect to the mounting plate. The construction is preferably such that the mounting plate is substantially completely hidden from view after the fixture is mounted thereon, thus providing the overall construction with an attractive and aesthetically pleasing appearance.

8 Claims, 10 Drawing Figures

FIXTURE MOUNTING ARRANGEMENT

TECHNICAL FIELD

The present invention relates generally to an arrangement for mounting a fixture such as a soap dish, towel rack, tissue holder, or the like on an associated supporting surface, and more particularly to a fixture mounting arrangement including a one-piece mounting plate adapted to be fixedly mounted on the supporting surface for cooperation with a retaining portion of the fixture to effect mounting of the fixture on the supporting surface.

BACKGROUND OF THE INVENTION

A very large variety of different types of fixtures are known which are configured for mounting on a wall or like associated supporting surface. Such fixtures may include soap dishes, towel racks, toothbrush holders, toilet tissue holders, as well as a number of other different like articles which provide convenience for users in the bathroom or other parts of the home. Devices of this nature are ordinarily mounted through the use of adhesives, mechanical fasteners, or like securement means, with the convenience of mounting such fixtures enhancing their appeal to consumers. Naturally, very good consumer acceptance of such articles is achieved by configuring such fixtures to have a neat and "finished" appearance after mounting.

Although fixtures of the above nature are generally straightforward in construction, consumer dissatisfaction can result if such devices are not readily mounted in the desired orientation. For example, some fixtures define openings for receiving mechanical fasteners to effect mounting, but consumers sometimes experience difficulty in effecting alignment of the fixture and correct positioning. Additionally, fixtures of this nature lack something in aesthetic appeal in that the mechanical fasteners are usually exposed to view.

Accordingly, it is very desirable to provide a fixture mounting arrangement which facilitates convenient mounting by consumers, and which at the same time permits mounting of a fixture so that its aesthetic appeal is enhanced and the finished installation is neat and attractive in appearance. It is further desirable that such a mounting arrangement be straightforward in construction for ease and efficiency of manufacture, particularly since fixtures of the above-described nature are ordinarily marketed as relatively low cost consumer items. With these desired goals in mind, the present fixture mounting arrangement has been particularly configured for ease of installation, economy of manufacture, and attractive appearance.

SUMMARY OF THE INVENTION

A fixture mounting arrangement embodying the principles of the present invention is configured to permit mounting of a fixture, such as a soap dish, tissue holder, towel rack, or the like, on an associated supporting surface in an essentially permanent fashion. In order to enhance the convenience of installation, the arrangement includes a one-piece mounting plate which is adapted to be fixedly mounted on the supporting surface with adhesive or mechanical fasteners. The mounting plate is configured to cooperate with a retaining portion defined by the associated fixture so that after securement of the mounting plate to the supporting surface, the fixture may merely be slid into engagement with the mounting plate, thus mounting the fixture on the supporting surface. Not only is the mounting plate easily fixed in its proper orientation on the supporting surface, the fixture is preferably configured such that the mounting plate is substantially hidden when the fixture is put in position, thus providing a highly attractive and aesthetically pleasing finish for the overall arrangement.

The one-piece mounting plate of the arrangement comprises at least one mounting portion which defines a substantially planar surface positionable in face-to-face relation with the associated supporting surface. The mounting plate further includes a pair of mounting flanges which extend laterally from the one or more mounting portions of the mounting plate. Notably, the mounting flanges extend generally angularly from a position spaced from the supporting surface toward the supporting surface, thus providing a configuration which effects a gripping or locking action with the associated retaining portion of the fixture. In the preferred form, the mounting plate is provided as a one-piece metal stamping, which not only facilitates economical manufacture, but which also desirably provides a resilient or spring-like gripping action with the associated fixture.

The retaining portion of the fixture is configured to effect detachable mounting of the fixture on the mounting plate, thus effecting mounting of the fixture on the supporting surface. The retaining portion of the fixture is preferably substantially vertically oriented, and defines at least one opening for receiving the one or more mounting portions of the mounting plate. By this configuration, the retaining portion of the fixture is positionable between the mounting flanges of the mounting plate and the supporting surface by relative vertical movement of the fixture with respect to the mounting plate. The mounting portion of the plate is thus received in the opening defined by the retaining portion of the fixture, and the retaining portion is held by the angularly extending mounting flanges of the mounting plate. By configuring the fixture such that its retaining portion is not exposed to view, the mounting plate is substantially hidden by the fixture, with the resulting installation having a neatly finished and professional appearance.

Convenience in positioning of the fixture on the mounting plate is facilitated by configuring at least one of the corner portions of each mounting flange to be spaced away from the associated supporting surface more than the spacing of the adjacent free edge of the flange. This preferred configuration is provided by bending the corner portions in a manner such that they do not follow the otherwise angular configuration of the mounting flanges. The retaining portion of the fixture is thus readily automatically guided into position between the mounting flanges and the supporting surface for the desired gripping action as the fixture is mounted on the mounting plate.

In the preferred form, both the upper and lower corners of each mounting flange are spaced in the above manner from the supporting surface, which thus permits the mounting plate to be correctly positioned regardless of which of its upper or lower edges is disposed upwardly, thus further facilitating convenient installation by consumers.

In one illustrated embodiment of the present mounting arrangement, the mounting plate comprises a single, centrally disposed mounting portion, with the mounting flanges extending laterally from respective opposite sides thereof. The mounting portion defines a peripheral edge which extends away from the supporting surface, with the mounting flanges extending angularly from the peripheral edge at a position spaced from the supporting surface. In this embodiment, the mounting plate further preferably defines upper and lower flange portions which respectively extend upwardly and downwardly from the peripheral edge of the centrally disposed mounting portion.

In an alternate embodiment, the mounting plate includes a pair of laterally spaced mounting portions each defining a respective substantially planar surface. In this embodiment, the pair of mounting flanges extend laterally from respective outer edges of the mounting portions for positioning of the retaining portion of the fixture between the mounting flanges and the associated supporting surface. In this embodiment, the mounting plate preferably includes an inner flange portion which extends laterally between respective inner edges of the mounting portions. The inner flange is preferably configured to be spaced from the supporting surface, with the retaining portion of the fixture defining a pair of laterally spaced openings for respectively receiving the mounting portions of the mounting plate. By this construction, the retaining portion of the fixture is positionable not only between the mounting flanges and the supporting surface, but is further positionable between the inner flange portion of the mounting plate and the supporting surface.

Numerous other features and advantages of the present invention will become readily apparent from the following detailed description, the appended claims, and the accompanying drawings.

DETAILED DESCRIPTION

Figure 1:
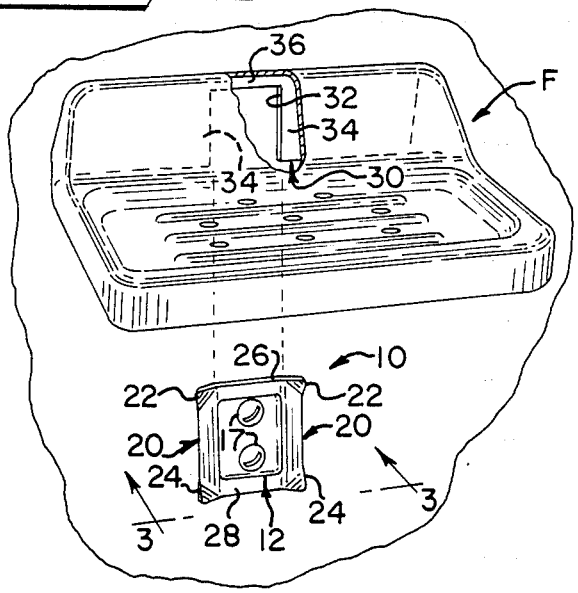
FIG. 1 is an exploded perspective view in partial cutaway illustrating a fixture mounting arrangement embodying the principles of the present invention.
Figure 3:
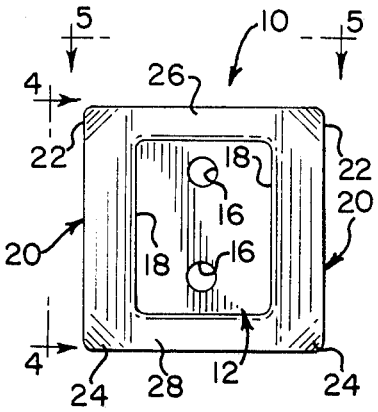
FIG. 3 is a front elevational view of a mounting plate of the mounting arrangement illustrated in FIG. 1, with the mounting plate being adapted to be fixedly secured to an associated supporting surface.
Figure 2:
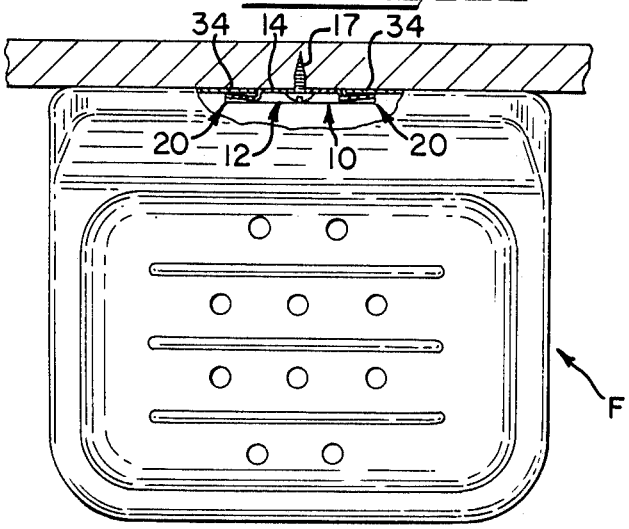
FIG. 2 is a top plan view in partial cutaway further illustrating the fixture mounting arrangement shown in FIG. 1.
Figure 4:
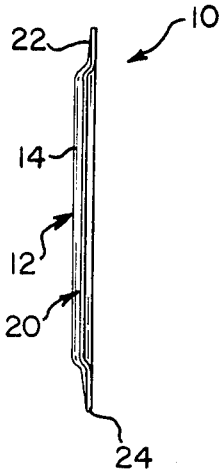
FIG. 4 is a side elevational view of the mounting plate shown in FIG. 3 taken along lines 4—4 in FIG. 3.

While the present invention is susceptible of embodiment in various forms, there is shown in the drawings and will hereinafter be described two presently preferred embodiments, with the understanding that the present disclosure is to be considered as an exemplification of the invention, and is not intended to limit the invention to the specific embodiments illustrated.

With reference now to FIGS. 1 to 5, therein is illustrated a fixture mounting arrangement embodying the principles of the present invention. The mounting arrangement is disclosed in conjunction with a fixture F which is illustrated as a soap dish. As will be appreciated by those skilled in the art, the present mounting arrangement is readily adaptable for the mounting of a very wide variety of different fixtures, and thus the disclosure of the arrangement in conjunction with fixture F shown as a soap dish is intended as illustrative, but not limiting.

The present mounting arrangement comprises a mounting plate 10 which is adapted to be fixedly secured to an associated wall or like supporting surface upon which the fixture F is to be mounted. While mounting plate 10 may be fabricated from various suitable materials, its formation as a one-piece metal stamping is preferred for economy of manufacture. In this regard, the mounting plate preferably comprises suitably plated metal or stainless steel for corrosion resistance and attractive finish, with the preferred metallic construction effecting a resilient gripping action when the fixture F is positioned for cooperation with the mounting plate.

In this embodiment, the mounting plate 10 includes a centrally disposed mounting portion 12, the rear of which defines a substantially planar surface 14. Surface 14 is positionable in face-to-face relation with the supporting surface to which the fixture F is to be mounted, and to this end, mounting portion 12 preferably defines one or more fastener openings 16 for receiving suitable mechanical fasteners 17 therethrough. As will be recognized, suitable adhesive may alternately be applied to the surface 14 for effecting the desired secure mounting of the plate 10 on the supporting surface.

In this embodiment, mounting portion 12 of the plate 10 includes an upstanding peripheral edge 18 which extends generally away from the supporting surface. The mounting plate further includes a pair of laterally extending mounting flanges 20 which extend from respective opposite edges of the mounting portion 12.

Figure 5:
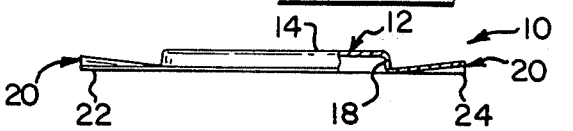
FIG. 5 is a top plan view of the mounting plate shown in FIG. 3 taken along lines 5—5 in FIG. 3.
Figure 6:
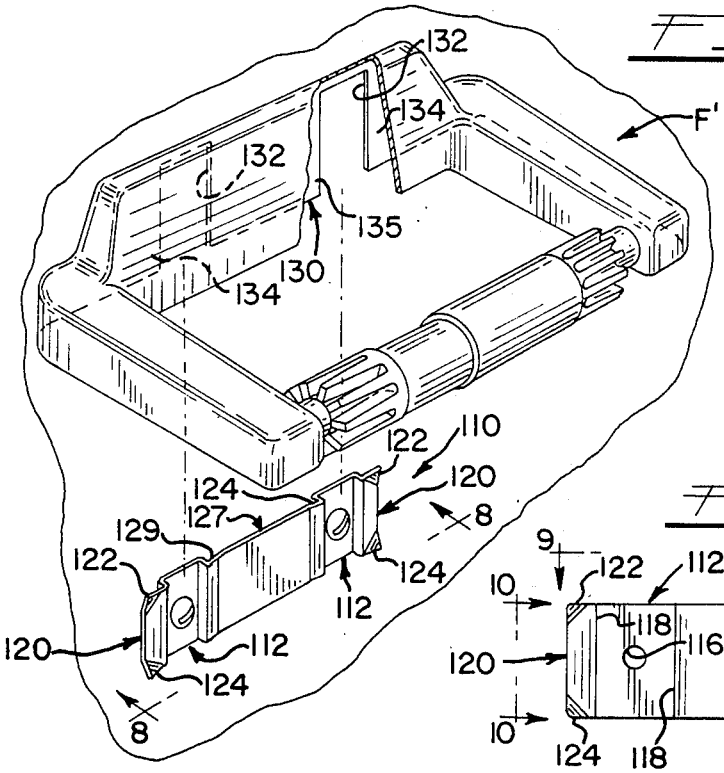
FIG. 6 is an exploded perspective view in partial cutaway of a further embodiment of the present fixture mounting arrangement.
Figure 8:
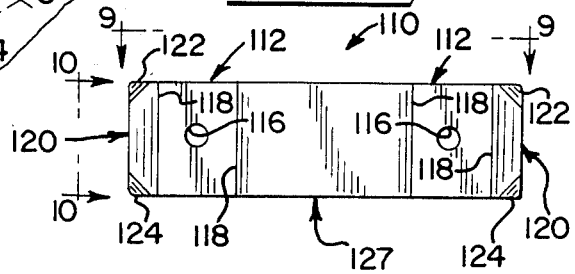
FIG. 8 is a front elevational view of a mounting plate of the arrangement shown in FIG. 6, with the mounting plate being adopted to be secured to the associated supporting surface.
Figure 7:
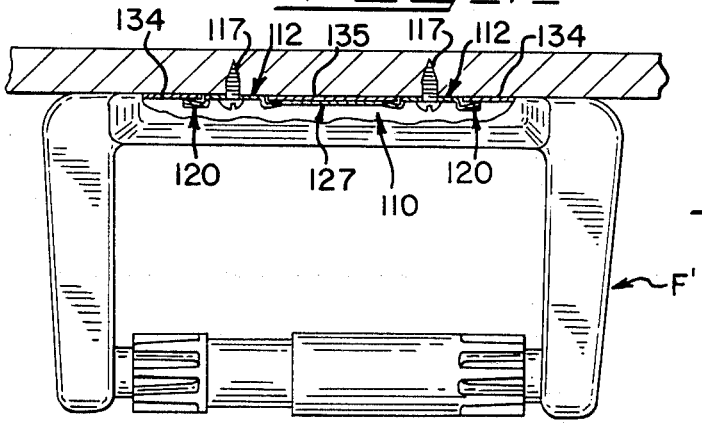
FIG. 7 is a top plan view in partial cutaway further illustrating the embodiment of the present mounting arrangement shown in FIG. 6.
Figure 9:
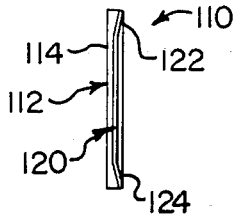
FIG. 9 is a side elevational view of the mounting plate illustrated in FIG. 8 taken along lines 9—9 in FIG. 8.
Figure 10:
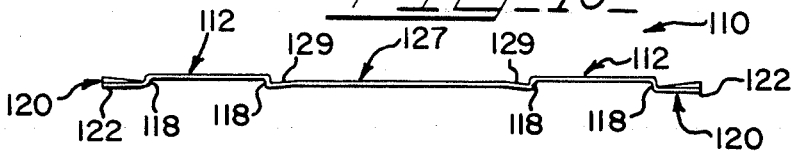
FIG. 10 is a top plan view of the mounting plate shown in FIG. 8 taken along lines 10—10 in FIG. 8.

Notably, the mounting flanges 20 have been particularly configured to effect secure retention of the fixture F on the mounting plate 10. As best shown in FIG. 5, each of the mounting flanges 20 extends from a position at peripheral edge 18 which is spaced from the supporting surface laterally generally angularly toward the supporting surface. By this construction, a retaining portion of the fixture F, as will be further described, is positionable between the mounting flanges and the supporting surface, with the flanges thus effecting a secure gripping action which acts to securely retain the fixture. As noted, the preferred metallic construction of the mounting plate provides a resiliency for the construction which permits the laterally extending flanges 20 to desirably provide a resilient gripping action.

As illustrated in the drawings, the upper and lower corner portions 22 and 24 of each mounting flange 20 are preferably shaped so as to be spaced from the supporting surface more than the spacing of the adjacent lateral free edge of the flange. Thus, the flange corner portions do not follow the generally angular configuration of the mounting flanges. This preferred construction facilitates positioning of the retaining portion of the fixture F between the mounting flanges and the supporting surface. By providing both of the upper and lower corners 22 and 24 of the mounting flanges with this preferred "bent away" configuration, it will be appreciated that mounting plate 10 will be correctly oriented for receiving the fixture F regardless of which of its upper and lower edges is positioned upwardly.

In the preferred embodiment, mounting plate 10 further includes upper and lower flange portions 26 and 28 which respectively extend upwardly and downwardly from peripheral edge 18 in spaced relation to the supporting surface. The flange portions 26 and 28 extend laterally between the mounting flanges 20, with the provision of both an upper and lower flange portion further providing the desired symmetrical configuration of the mounting plate to facilitate its correct orientation on the supporting surface. The spaced relation of each flange portion 26 and 28 with respect to the supporting surface is such that the retaining portion of the fixture F is positionable between the upper one of the flange portions and the supporting surface. Secure mounting of the fixture F on the mounting plate is thus enhanced.

As noted, the fixture F is configured for cooperation with the mounting plate 10, and to this end, includes a substantially planar, vertically oriented retaining portion, generally designated 30. Ordinarily, the retaining portion 30 of the fixture F will be disposed at the rear of the fixture, and thus will be positioned in face-to-face relation with the supporting surface when the fixture is positioned on the mounting plate 10.

The retaining portion 30 defines an opening 32 which is configured for receiving the mounting portion 12 of mounting plate 10 when the fixture is positioned in engagement with the mounting plate. By this configuration, a pair of lateral retaining portions 34 are thus provided on the fixture which are respectively positionable between mounting flanges 20 of plate 10 and the supporting surface. In this embodiment, an upper retaining portion 36 is further provided which is positionable between the upper one of flange portions 26 and 28 of the mounting plate 10 and the supporting surface.

From the foregoing description, the manner in which mounting of fixture F is effected will be readily appreciated. The mounting plate 10 is first affixed in the desired position on the supporting surface, with its preferred symmetrical configuration facilitating mounting in the correct orientation. Suitable mechanical fasteners 17 are inserted through openings 16 for securing the mounting plate to the supporting surface, and the installation job is all but complete. The fixture F can now be easily positioned just above the mounting plate, and thereafter relatively vertically moved downwardly so that mounting portion 12 of the plate is received within opening 32, with the lateral retaining portions 34 of the fixture being positioned between mounting flanges 20 and the supporting surface. As noted, the preferred spacing of the corner portions of the mounting flanges from the supporting surface acts to guide the lateral portions 34 of the fixture into the correct position, with the angular configuration of the mounting flanges providing the desired secure retention of the fixture.

As the fixture is moved downwardly to its fully seated position, upper retaining portion 36 is positioned between upper flange portion 26 of the mounting plate 10 and the supporting surface, and installation is then complete. As will be appreciated, the preferred configuration of the arrangement is such that the mounting plate 10 is substantially hidden from view, and thus the overall appearance of the fixture is very attractive. Because of the detachable nature of the fixture with respect to the mounting plate 10, the fixture can be easily removed from the mounting plate, and the mounting plate removed from the supporting surface, if desired.

An alternate embodiment of the present invention is illustrated in FIGS. 6 to 10. In this embodiment, elements which correspond to elements of the above-described embodiments are so indicated by like reference numerals in the 100 series. Like the previously described embodiment, the alternate embodiment is configured for very convenient mounting of a fixture, designated F', which is illustrated as comprising a toilet tissue holder.

In this alternate embodiment, a mounting plate 110 is provided which preferably comprises a one-piece metal stamping. The mounting plate 110 includes a pair of laterally spaced mounting portions 112, the rear of each of which defines a substantially planar surface 114 positionable in face-to-face relation with the supporting surface. Fastener openings 116 are provided for effecting the securement of the mounting plate 110 to the supporting surface with suitable mechanical fasteners 117.

In this embodiment, each of the mounting portions 112 includes laterally opposite upstanding edges 118 which extend generally away from the supporting surface. The mounting plate 110 further includes a pair of laterally spaced mounting flanges 120 which extend generally angularly toward the supporting surface from respective outer edges 118 of the mounting portions 112. As in the previous embodiment, the mounting flanges 120 extend angularly from a position spaced from the supporting surface theretoward, thus providing the desired gripping action with a retaining portion of the associated fixture F'. Convenience of installation is likewise facilitated by providing the upper and lower corner portions 122 and 124 of the mounting flanges 120 with a configuration such that they are spaced from the supporting surface more than the spacing of the adjacent lateral free edges of the flanges, and thus do not follow the generally angular configuration of the mounting flanges. Again, the symmetrical configuration of the mounting plate 110 facilitates convenient installation in its correct orientation.

The mounting plate 110 includes an inner flange 127 which extends laterally between respective inner edges 118 of the mounting portions 112. As will be further described, inner flange 127 is preferably positionable in spaced relation to the supporting surface, with the mounting plate 110 thus being configured such that the retaining portion of the associated fixture is positionable between the inner flange 121 and the supporting surface. In this regard, it will be observed that the inner flange 127 preferably includes opposite angular edge portions 129 which extend at an angle from the respective inner edges 118 toward the supporting surface. By this construction, the spacing between the central portion of the inner flange 127 and the supporting surface generally corresponds to the thickness of the retaining portion of the fixture so that the retaining portion is securely received between the inner flange and the supporting surface.

With particular reference to the illustrated fixture F′, the fixture includes a vertically oriented, substantially planar retaining portion 130 which is configured for cooperation with the mounting plate 110. In this embodiment, the retaining portion 130 preferably defines a pair of openings 132 for respectively receiving the mounting portions 112 of the mounting plate 110. The retaining portion 130 is thus configured to include a pair of lateral retaining portions 134 disposed on respective opposite sides of the openings 132, and an inner retaining portion 135 disposed between the openings 132.

Mounting of the fixture F′ on the supporting surface is very simple and straightforward. The mounting plate 110 is positioned as desired on the supporting surface, and secured thereto with mechanical fasteners 117 inserted through openings 116. The fixture F′ can now be easily mounted on the plate 110 by merely positioning the fixture just above the mounting plate, and thereafter relatively moving the fixture downwardly. By this action, mounting portions 112 are received within openings 132 as the lateral retaining portions 134 are positioned between mounting flanges 120 and the supporting surface. Secure mounting of the fixture on the mounting plate is further provided by the positioning of inner retaining portion 135 between inner flange 127 and the supporting surface. After the fixture has been fully seated on the mounting plate installation is complete, with a very attractive overal finish provided in view of the mounting plate 110 (and its mechanical fasteners) being substantially hidden from view.

From the foregoing, it will be observed that numerous variations and modifications may be effected without departing from the true spirit and scope of the novel concept of the present invention. It will be understood that limitations with respect to the specific embodiments illustrated herein is intended or should be inferred. It is, of course, intended to cover by the appended claims all such modifications as fall within the scope of the claims.

What is claimed is:

1. An arrangement for mounting a fixture on an associated supporting surface, comprising:

one-piece mounting plate means adapted to be fixedly mounted on said supporting surface, said plate means comprising a centrally disposed mounting portion defining a substantially planar surface positionable in face-to-face relation with said supporting surface, and mounting flange means comprising a pair of mounting flanges extending laterally from respective opposite sides of said mounting portion, said mounting flange means extending laterally generally angularly from a position spaced from said supporting surface toward said supporting surface, each of said mounting flanges including an upper corner portion spaced away from said supporting surface more than the spacing of an adjacent free edge of the respective one of said mounting flanges; and means defined by said fixture for cooperation with said mounting plate means to effect mounting of said fixture on said supporting surface comprising a substantially vertically oriented retaining portion defining an opening for receiving said mounting portion of said plate means, said retaining portion of said fixture being positionable between said mounting flange means and said supporting surface by relative vertical movement of said fixture with respect to said mounting plate means so that said mounting portion is received in said opening and said retaining portion is held between and in contact with said associated supporting surface and said angularly extending mounting flange means, said mounting plate means including an upper flange portion extending upwardly from said centrally disposed mounting portion and extending laterally between said mounting flanges in spaced relation to said supporting surface so that said retaining portion of said fixture is positionable between the upper flange portion and said supporting surface.

2. A fixture mounting arrangement in accordance with claim 1, wherein a lower corner portion of each said mounting flange of said mounting flange means is spaced away from said supporting surface more than the spacing of the adjacent free edge of said flange means to facilitate positioning of said retaining portion of said fixture between said mounting flange means and said supporting surface.

3. A fixture mounting arrangement in accordance with claim 1, wherein said mounting portion of said mounting plate means defines means for receiving mechanical fastener means for fixedly mounting said mounting plate means on said supporting surface.

4. An arrangement for mounting a fixture on an associated supporting surface, comprising:

one-piece mounting plate means adapted to be fixedly mounted on said supporting surface, said plate means comprising at least one mounting portion defining a substantially planar surface positionable in face-to-face relation with said supporting surface, and mounting flange means extending laterally from said mounting portion, said mounting flange means extending laterally generally angularly from a position spaced from said supporting surface toward said supporting surface; and means defined by said fixture for cooperation with said mounting plate means to effect mounting of said fixture on said supporting surface comprising a substantially vertically oriented retaining portion defining at least one opening for receiving said mounting portion of said plate means, said retaining portion of said fixture being positionable between said mounting flange means and said supporting surface by relative vertical movement of said fixture with respect to said mounting plate means so that said mounting portion is received in said opening and said retaining portion is held by said angularly extending mounting flange means;

said mounting plate means comprising a laterally spaced pair of said mounting portions each defining a respective one of said substantially planar surface, said retaining portion of said fixture defining a laterally spaced pair of said openings for respectively receiving said mounting portions of said plate means, said mounting flange means comprising a pair of mounting flanges respectively laterally extending from laterally outer edges of said mounting portions, said mounting plate means including an inner flange extending laterally between respective inner edges of said pair of mounting portions, said inner flange being spaced from said supporting surface for positioning of said retaining portion of said fixture between said inner flange and said supporting surface.

5. A fixture mounting arrangement in accordance with claim 4, wherein each said mounting flange includes at least one upper and lower corner portion spaced away from said supporting surface more than the spacing of adjacent free edges of said mounting flanges to facilitate positioning of said retaining portion of said fixture between said mounting flanges and said supporting surface, and opposite edge portions of said inner flange extend angularly inwardly from said mounting portions so that the spacing between said inner flange and said supporting surface generally corresponds to the thickness of said retaining portion of said fixture.

6. An arrangement for mounting a fixture on an associated supporting surface, comprising:

one-piece mounting plate means adapted to be fixedly mounted on said supporting surface, said mounting plate means including a centrally disposed mounting portion defining a substantially planar surface positionable in face-to-face relation with said supporting surface, said mounting portion including an upstanding peripheral edge extending generally away from said planar surface, said mounting plate means further including mounting flange means comprising a pair of laterally spaced mounting flanges extending laterally from respective lateral portions of said peripheral edge of said mounting portion, each said mounting flange extending generally angularly from a position spaced from said supporting surface toward said supporting surface, with at least one of an upper and lower corner portion of each said mounting flange being spaced away from said supporting surface more than the spacing of an adjacent free edge of said flange;

said mounting plate means further including an upper flange portion extending upwardly from said mounting portion and extending laterally between said mounting flanges in spaced relation to said supporting surface; and means defined by said fixture for cooperation with said mounting plate means to effect detachable mounting of said fixture on said supporting surface comprising a substantially vertically oriented retaining portion defining an opening for receiving said mounting portion of said plate means, said retaining portion of said fixture being positionable between said mounting flanges and said supporting surface, and between said upper flange portion and said supporting surface, by relative vertical movement of said fixture with respect to said mounting plate means so that said mounting portion is received in said opening and said retaining portion is held by said angularly extending mounting flanges and said upper flange portion.

7. An arrangement for mounting a fixture on an associated supporting surface, comprising:

one-piece mounting plate means adapted to be fixedly mounted on said supporting surface, said plate means comprising a pair of laterally spaced mounting portions each defining a substantially planar surface positionable in face-to-face relation with said supporting surface, and a pair of mounting flanges extending laterally from respective outer edges of said mounting portions, said mounting flanges extending laterally generally angularly from a position spaced from said supporting surface toward said supporting surface, each said mounting flange including at least one upper and lower corner portion spaced away from said supporting surface more than the spacing of an adjacent free edge of said flange; and means defined by said fixture for cooperation with said mounting plate means to effect detachable mounting of said fixture on said supporting surface comprising a substantially vertically oriented retaining portion defining a pair of laterally spaced openings for respectively receiving said mounting portions of said mounting plate means, said retaining portion of said fixture being positionable between said mounting flanges and said supporting surface by relative vertical movement of said fixture with respect to said mounting plate means so that said mounting portions are received in said openings and said retaining portions is held by said angularly extending mounting flanges;

said mounting plate means including an inner flange extending laterally between respective inner edges of said pair of mounting portions, said inner flange being spaced from said supporting surface for positioning of said retaining portion of said fixture between said inner flange and said supporting surface.

8. An arrangement for mounting a fixture on an associated supporting surface, comprising:

one-piece mounting plate means adapted to be fixedly mounted on said supporting surface, said mounting plate means including a centrally disposed mounting portion defining a substantially planar surface positionable in face-to-face relation with said supporting surface, said mounting portion including an upstanding peripheral edge extending generally away from said planar surface, said mounting plate means further including mounting flange means comprising a pair of laterally spaced mounting flanges extending laterally from respective lateral portions of said peripheral edge of said mounting portion, each said mounting flange extending generally angularly from a position spaced from said supporting surface toward said supporting surface, with at least one of an upper and lower corner portion of each said mounting flange being spaced away from said supporting surface more than the spacing of an adjacent free edge of said flange; and means defined by said fixture for cooperation with said mounting plate means to effect detachable mounting of said fixture on said supporting surface comprising a substantially vertically oriented retaining portion defining an opening for receiving said mounting portion of said plate means, said retaining portion of said fixture being positionable between said mounting flanges and said supporting surface by relative vertical movement of said fixture with respect to said mounting plate means so that said mounting portion is received in said opening and said retaining portion is held by said angularly extending mounting flanges;

said mounting plate means further including upper and lower flange portions respectively extending upwardly and downwardly from said upstanding peripheral edge in spaced relation to said supporting surface, said upper and lower flanges extending laterally between said mounting flanges, said retaining portion of said fixture being positionable between the upper one of said flange portions and said supporting surface.

* * * * *